US008516746B2

(12) United States Patent
Polimeni et al.

(10) Patent No.: US 8,516,746 B2
(45) Date of Patent: Aug. 27, 2013

(54) METHOD FOR SELF-ADAPTIVE REGULATION OF THE POSITION OF THE WINDOW PANE OF A MOTOR-VEHICLE DOOR WITH FRAMELESS WINDOW, AND MOTOR-VEHICLE DOOR PROVIDED FOR SAID METHOD

(75) Inventors: Gaetano Polimeni, Turin (IT); Mauro Bigando, Turin (IT); Federico Ferrero, Turin (IT); Dario Occelli, Castagnole Piemonte (IT)

(73) Assignee: Fiat Group Automobiles S.p.A., Turin (IT)

( * ) Notice: Subject to any disclaimer, the term of this patent is extended or adjusted under 35 U.S.C. 154(b) by 0 days.

(21) Appl. No.: 13/287,454

(22) Filed: Nov. 2, 2011

(65) Prior Publication Data

US 2012/0102838 A1 May 3, 2012

(30) Foreign Application Priority Data

Nov. 2, 2010 (EP) ..... 10189704

(51) Int. Cl.
*E05F 11/48* (2006.01)

(52) U.S. Cl.
USPC ..... 49/352; 49/375

(58) Field of Classification Search
USPC ..... 49/348, 349, 352, 374, 375, 502
See application file for complete search history.

(56) References Cited

U.S. PATENT DOCUMENTS 4,848,032 A * 7/1989 Ballor et al. ..... 49/350
4,910,917 A * 3/1990 Brauer ..... 49/348
4,927,207 A * 5/1990 Kishino ..... 49/490.1
5,537,783 A * 7/1996 Kazino et al. ..... 49/375
5,622,005 A * 4/1997 Ochenski et al. ..... 49/375
5,729,930 A * 3/1998 Schust et al. ..... 49/375
5,966,872 A * 10/1999 Wasek et al. ..... 49/375
6,152,636 A * 11/2000 Nass ..... 403/13
6,283,534 B1 * 9/2001 Mrozowski et al. ..... 296/146.2
6,640,497 B2 * 11/2003 Sakaguchi et al. ..... 49/352

(Continued)

FOREIGN PATENT DOCUMENTS

DE 10 2005 020 052 A1 11/2006

OTHER PUBLICATIONS

European Search Report, dated Apr. 15, 2011, for corresponding European Application No. 10189704.9, filed Nov. 2, 2010.

*Primary Examiner* — Terrell McKinnon
*Assistant Examiner* — Abe Massad
(74) *Attorney, Agent, or Firm* — Heslin Rothenberg Farley & Mesiti P.C.; Victor A. Cardona, Esq.

(57) ABSTRACT

A motor-vehicle door with frameless window includes a door structure, a window pane, slidably mounted on the door structure between a lowered position and a raised position, and a regulating device, for controlling movement of the pane. Connected to the pane is a slider member, which engages a respective guide element mounted on the door structure. Operatively set between the slider member and the pane is an elastically deformable member. In its undeformed condition, the deformable member tends to keep the pane in an out-of-tolerance position, more raised and/or set further back with respect to its correct position of assembly on the slider member. Clamping means are provided for adjusting the position of the pane on the slider member so as to compensate, during assembly, the deviation from the nominal design position due to the tolerances of the processes of production of the bodies and the windows.

12 Claims, 9 Drawing Sheets

(56) References Cited

U.S. PATENT DOCUMENTS 7,596,908 B2 * 10/2009 Rothe et al. ..... 49/374
2005/0076572 A1 * 4/2005 Cardine et al. ..... 49/348
2006/0260200 A1 11/2006 Bigourden
2009/0211159 A1 * 8/2009 Iennarella et al. ..... 49/358

* cited by examiner

METHOD FOR SELF-ADAPTIVE REGULATION OF THE POSITION OF THE WINDOW PANE OF A MOTOR-VEHICLE DOOR WITH FRAMELESS WINDOW, AND MOTOR-VEHICLE DOOR PROVIDED FOR SAID METHOD

CROSS-REFERENCE TO RELATED APPLICATION

This application claims priority from European Patent Application No. 10189704.9, filed on Nov. 2, 2010, the entire disclosure of which is incorporated herein by reference.

SUMMARY OF THE INVENTION

The present invention relates to doors of motor vehicle of the type indicated in the preamble of Claim 1.

The field of application of the present invention is that of motor vehicles provided with side doors with frameless window and with power window-regulator system. The invention is designed in particular to be advantageously applied in lines for final assembly of vehicles in order to improve the functional and aesthetic quality of the product and enable implementation of adaptive assembly methods that will improve the productivity and reliability of the production processes.

Constituting a specific object of the present invention is a door of the type indicated in the preamble of Claim 1 that can be installed on the vehicle with simple and fast operations, ensuring proper matching with its own seat on the side of the vehicle, according to the nominal design position.

In particular, an object of the invention is to render objective the regulation carried out with a servo-assisted manual method, ensuring in the configuration with door closed and window raised proper matching with its own seat on the side in order to guarantee proper operation of the window and a reliable weatherproofing against penetration of water or air in the closed condition of the window.

With a view to achieving the aforesaid purposes, the subject of the invention is a door of the type indicated above, characterized in that:

- operatively set between the aforesaid slider member and the aforesaid window pane is an elastically deformable member;
- blocking means are provided to secure said slider member on said window pane;
- in the released condition of said blocking means, the aforesaid elastically deformable member is in an undeformed resting configuration, in which it keeps the window pane in an out-of-tolerance position, i.e., more raged and/or more shifted longitudinally, with respect to its correct position of assembly on said slider member;
- the aforesaid blocking means being designed to secure said window pane in a correct position of assembly thereof on said slider member, in which said elastically deformable member is deformed with respect to its resting configuration.

Thanks to said arrangement, the door according to the invention enables the operation of regulation of the correct position of the window pane to be carried out in an easy, fast, and precise way.

According to the invention, it is in fact sufficient to provide the aforesaid door structure with the window pane connected to one or more slider members with the interposition of one or more elastically deformable members of the type indicated above and with the aforesaid blocking means initially in their released condition, so that each of said elastically deformable members is in its undeformed condition and the pane is consequently kept in the aforesaid out-of-tolerance position, i.e., more raised and/or more shifted longitudinally (for example, shifted back), with respect to its correct position of assembly on each slider member.

In said initial condition, the pane is set in a position away from its raised closing position.

Starting from said condition, according to the method of the invention, the regulating device is activated to bring about a movement of the window as far as its raised closing position, where it comes into contact against the edge of the motor-vehicle door opening or against a mock-up of the edge of the door opening (according to whether the operation of regulation is carried out directly with the door already mounted on the vehicle, or else off-line in a workstation where a mock-up of the edge of the door opening is provided).

In this way, when the window pane reaches the aforesaid raised closing position, it moves automatically into the correct position with respect to the slider member or members, thanks to a simultaneous deformation of the aforesaid elastically deformable member. In this condition, the connection between the pane and the slider member is blocked by means of the aforesaid clamping means, and correct regulation of the pane is thus obtained.

Preferably, the door according to the invention is designed to facilitate also the operation of regulation of the position of the pane in the direction orthogonal to the general plane of the pane. For this purpose, the guide means for controlling vertical movement of the pane comprise at least one elongated guide element having a top end connected in an articulated way to the structure of the door about a longitudinal axis (i.e., an axis parallel to the longitudinal direction of the motor vehicle, with reference to the mounted condition of the door).

Thanks to said characteristic, the operation of regulation of the correct position of the pane in the direction orthogonal to the general plane of the pane can be simply carried out by bringing the pane into its raised position and causing rotation of the ensemble constituted by the guide element and the pane about the aforesaid axis of articulation until proper engagement is obtained of the top edge of the pane against the edge of the opening of the motor-vehicle door (in the case where the regulation is carried out on the motor-vehicle assembly line) or of a mock-up of said edge (in the where the regulation is carried out in a regulation workstation, located off-line).

The structure of the door is provided with means for blocking the aforesaid guide element with respect to the structure of the door in a pre-set position about the aforesaid axis of articulation. In the preferred embodiment, said means are constituted by screw devices that engage a bottom end of the guide element as well as a slit made in a bracket forming part of the structure of the door.

As emerges clearly from the characteristics indicated above, the invention enables regulation of the correct position of the window pane to be carried out with simple and fast operations, which can be readily automated, with considerable saving in terms time on the part of the operators.

Said result is obtained primarily thanks to the provision of the aforesaid elastically deformable member, the function of which is to set the pane always in a position, established beforehand, outside the design limits (i.e., shifted further along z and x).

Preferably, the method according to the invention is characterized in that said operation of regulation of the correct position of the pane is carried out in a dedicated workstation, off the motor-vehicle assembly line, by providing contrast elements that simulate the edge of the motor-vehicle door opening that is to come into contact with the edge of the pane in the closed condition of the latter, in that said contrast elements are controlled in position by respective actuator means, and in that said actuator means are controlled as a function of signals issued by measuring means designed to detect the edge of the motor-vehicle door opening.

In this case, by carrying out assembly on a specifically equipped bench, it is consequently possible to carry out in a precise way compensation for the position in x, y and z, through the aforesaid contrasts, which are self-adapted on-process on the basis of the geometrical measurements made on each body. In this way, any critical operations on the final vehicle assembly line are avoided.

BRIEF DESCRIPTION OF THE DRAWINGS

Further characteristics and advantages of the invention emerge from the ensuing description with reference to the annexed drawings, which are provided purely by way of non-limiting example and in which.

DETAILED DESCRIPTION OF THE INVENTION

Figure 1:
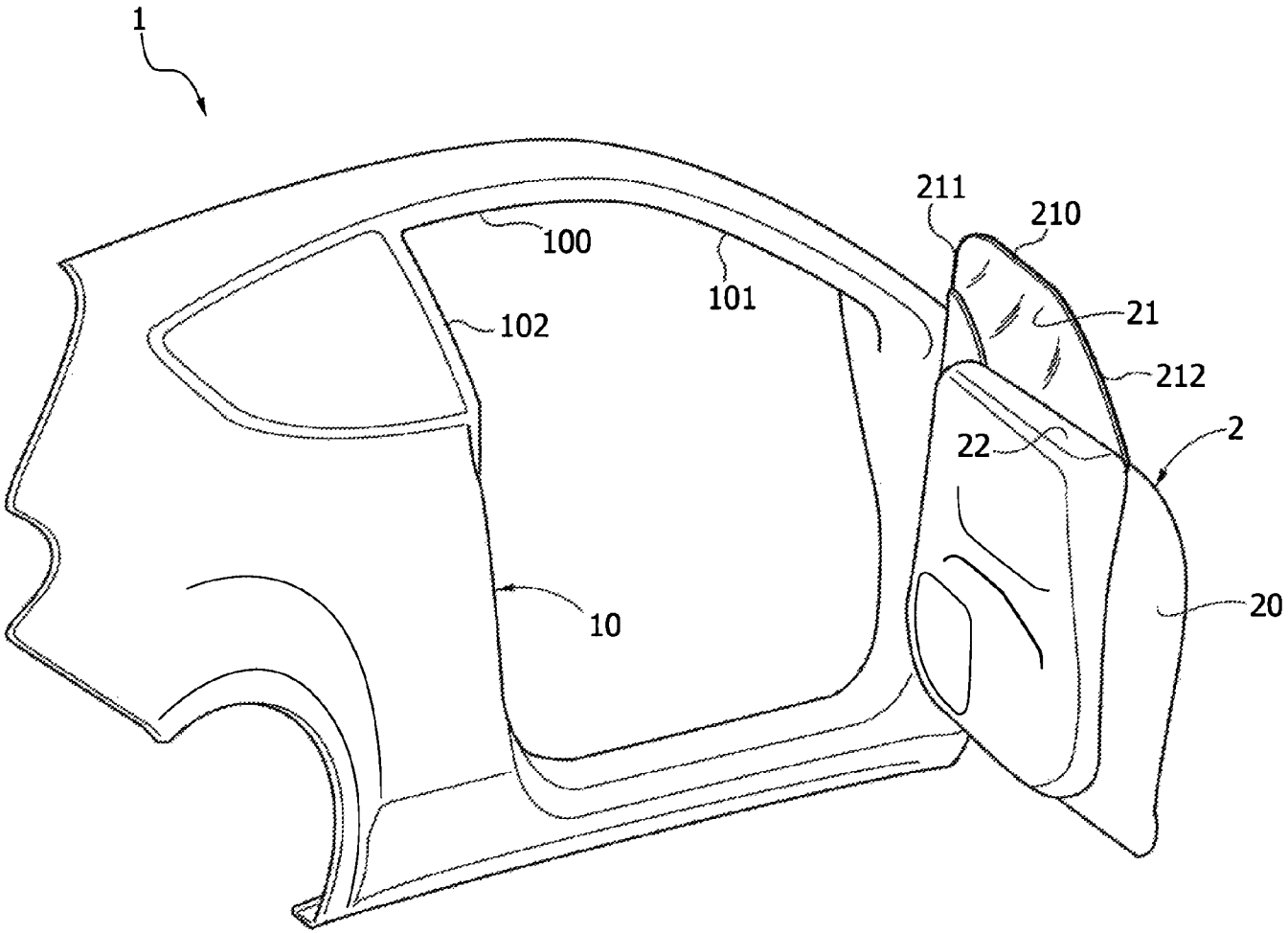
FIG. 1 is a partial view of a motor vehicle provided with a door according to the invention, illustrated in the open condition.

In FIG. 1, the reference number 1 designates as a whole a motor vehicle provided with a side door 2, having a front edge articulated to the structure of the motor vehicle 1 about a vertical axis, by means of hinges of any known type (not visible in the drawings). The door 2 is of the type with frameless window. It comprises a door structure 20, mounted vertically slidable in which is a window pane 21. The pane 21 is mobile between a lowered position, where it is received within the door structure 20, and a raised position (visible in FIG. 1), where it projects beyond the top edge 22 of the door structure 20.

As has been said, the door structure 20 does not include a window frame projecting above the top edge 22. Consequently, in the raised position of the pane 21, the top edge 210, the front edge 211, and the rear edge 212 of the pane 21 come directly into contact with corresponding portions 100, 101, 102 (FIG. 1) of the opening 10 for the door 2 defined by the body of the motor vehicle 1. Provided along the edge of the opening 10 are of course one or more weatherproofing elements (not visible in the drawings), of any known type, cooperating with the door structure 20 and with the pane 21 when the door 2 is closed and the pane is in its raised position in order to guarantee proper weatherproofing against infiltration of water and air.

Said result implies a correct positioning of the pane 21 with respect to the structure of the door with consequent need, during the operations of assembly of the door, to carry out an operation of regulation of the position of the pane. As has been mentioned above, the invention achieves the object of rendering the operation of window regulation simple, fast, and precise, with the use of automatic-regulating devices.

Figure 2:
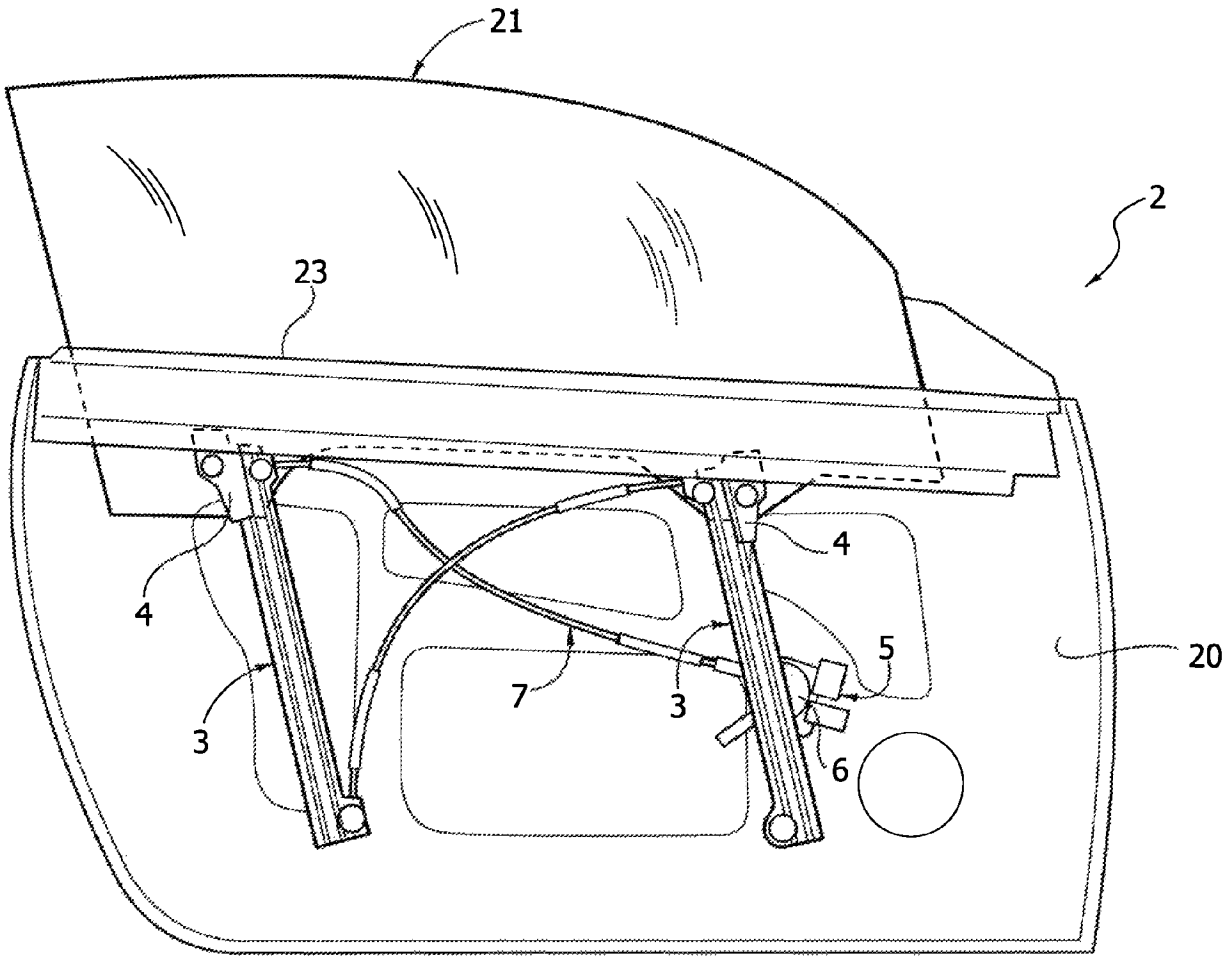
FIG. 2 is a view of the structure of the door, in the general plane of the door.

The structure 20 of the door is provided, in the case of the example illustrated herein, according to the traditional technique, by means of coupling of an external panel of sheet metal with an internal framework, which is also made of sheet metal. FIG. 2 shows the inside of the structure 20 of the door, in so far as one of the two elements of sheet metal constituting the door has been removed. FIG. 2 does not illustrate either the anti-intrusion reinforcement bar, which is provided within the structure of the door, substantially in the longitudinal direction of the motor vehicle (the horizontal direction in FIG. 2) in order to protect the driver or the passenger in the case of side-on collision.

Figure 3A:
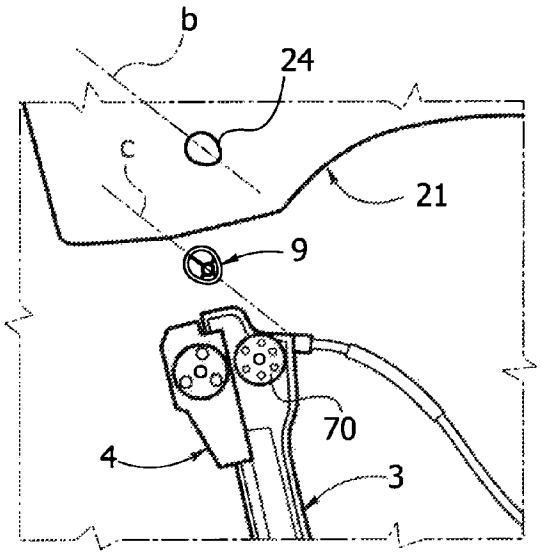
FIG. 3A illustrates a detail at an enlarged scale of FIG. 3.
Figure 3:
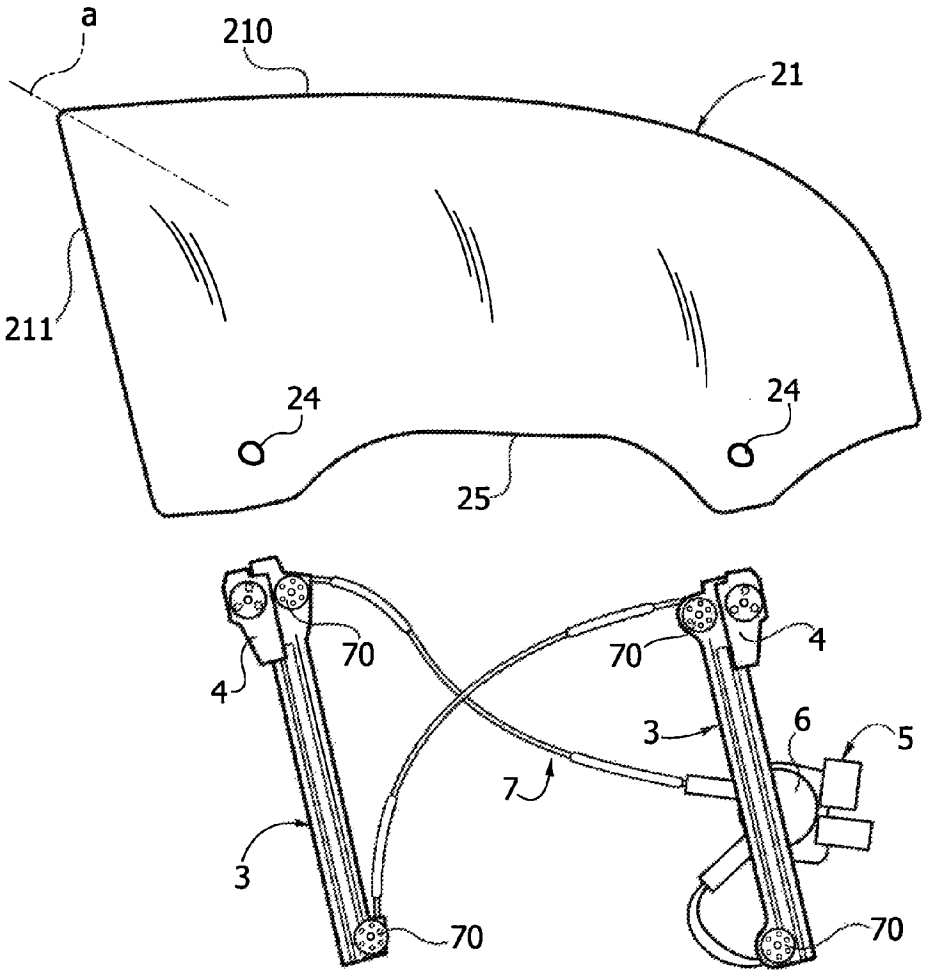
FIG. 3 is an exploded view of the pane for the doors and of the corresponding guide means, with the regulating device for governing movement of the pane.
Figure 4A:
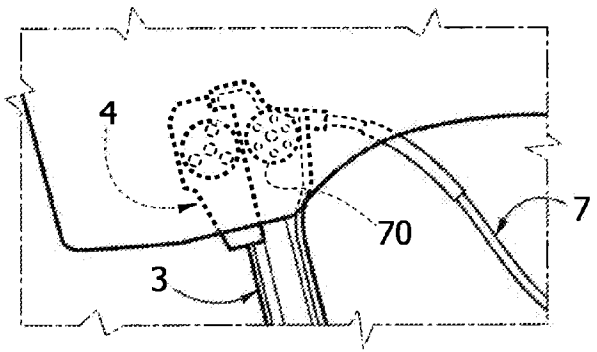
FIG. 4A illustrates a detail of FIG. 4 at an enlarged scale.
Figure 4:
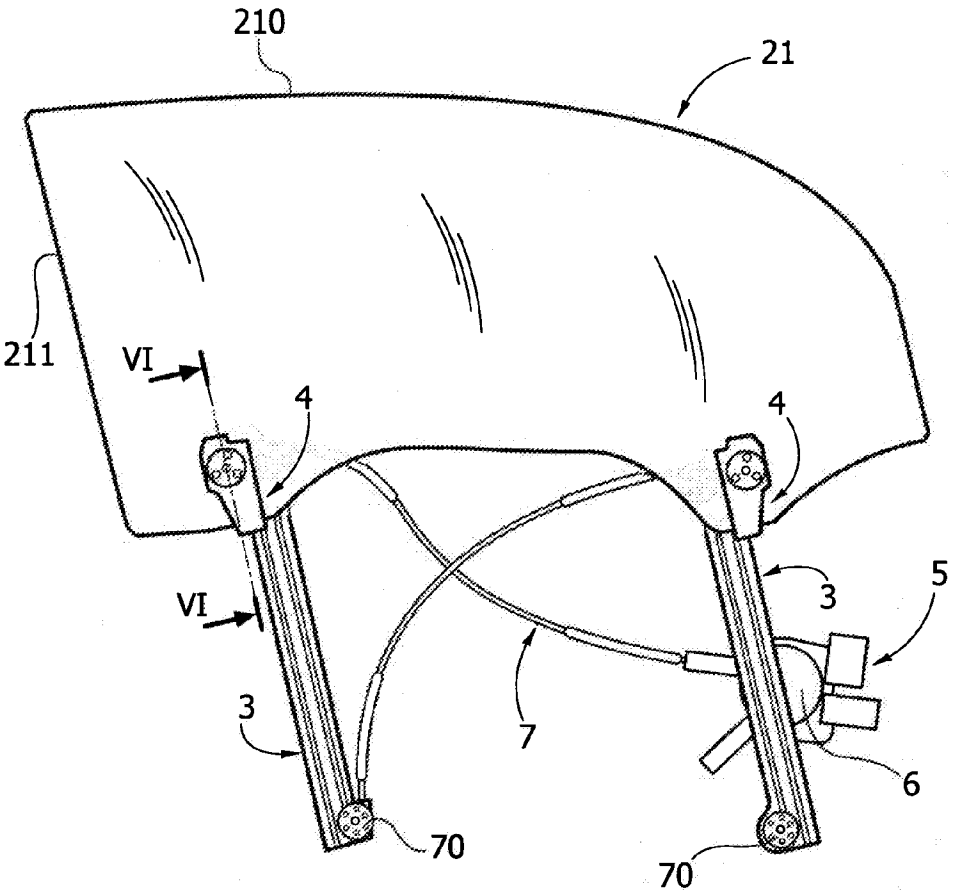
FIG. 4 is an assembled view of the components of FIG. 3.
Figure 5:
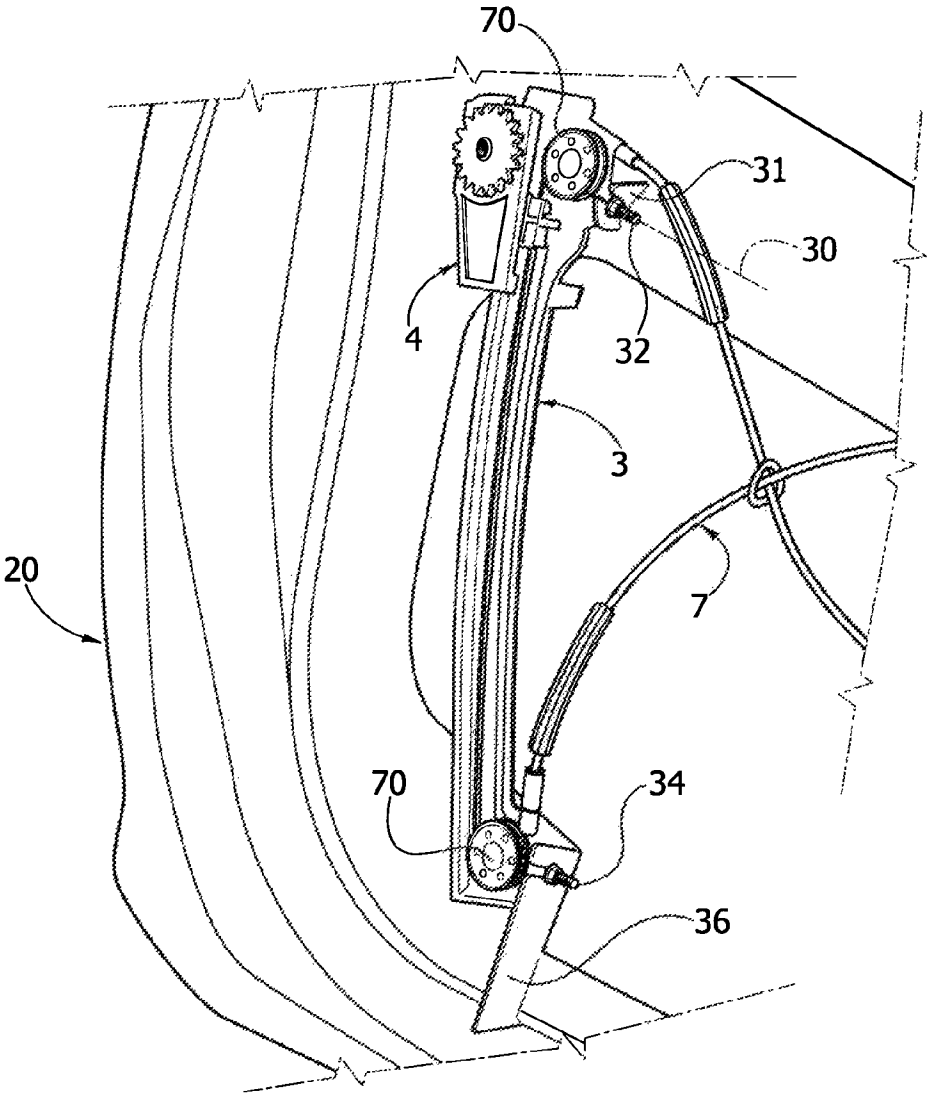
FIG. 5 is a perspective view of a guide element of the pane.
Figure 5B:
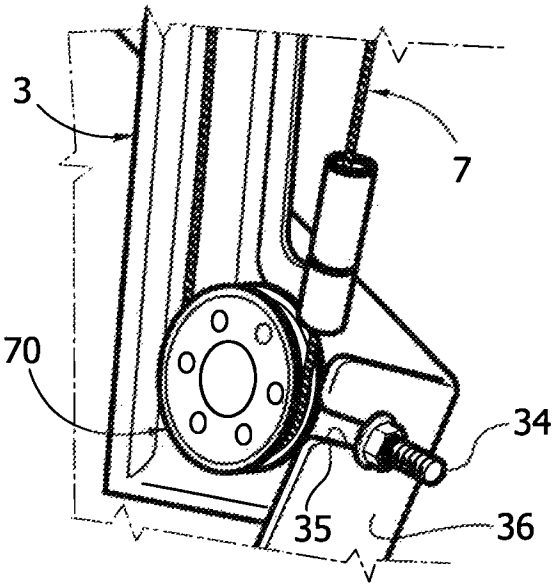
FIGS. 5A, 5B illustrate two details of FIG. 5 at an enlarged scale.
Figure 5A:
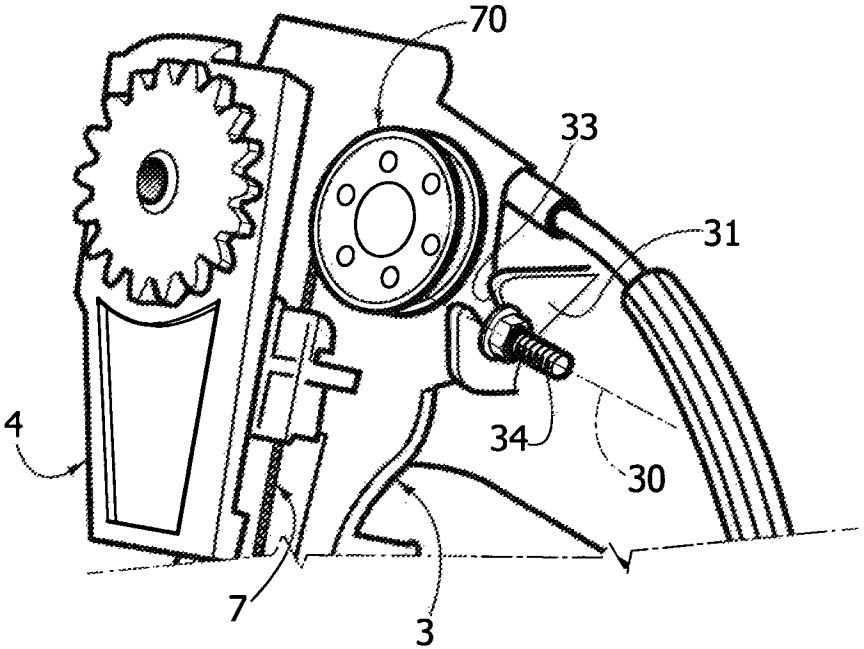

With reference to FIG. 2, mounted on the structure 20 of the door 2, in the way that will be described in detail in what follows, are two guide elements 3 for guiding vertical movement of the window pane 21. Connected on the rear edge of the pane 21 are two slider members 4, which slidably engage the two guide elements 3. The pane 21 is moreover of course guided within a slit 23 defined along the top edge 22 of the door and provided, in a way in itself known, with weatherproofing elements (not illustrated). The movement of the pane 21 between its raised position (visible in FIG. 2) and its lowered position (in which it is received within the structure of the door), is controlled by a regulating device 5 of any known type. In the case of the example illustrated, the regulating device 5 comprises an electric-motor/reducer assembly 6, which causes linear movement of a flexible cable 7, which is guided via return pulleys 70 (FIGS. 5, 5A, 5B) along a closed path, which includes two stretches arranged within the guide elements 3, according to what is shown in FIGS. 2 and 3. In this way, activation of the device 5 causes simultaneous movement of the two slider members 4 upwards or downwards with respect to the guide elements 3, the rotation of the motor that forms part of the assembly 6 being reversible.

Figure 6:
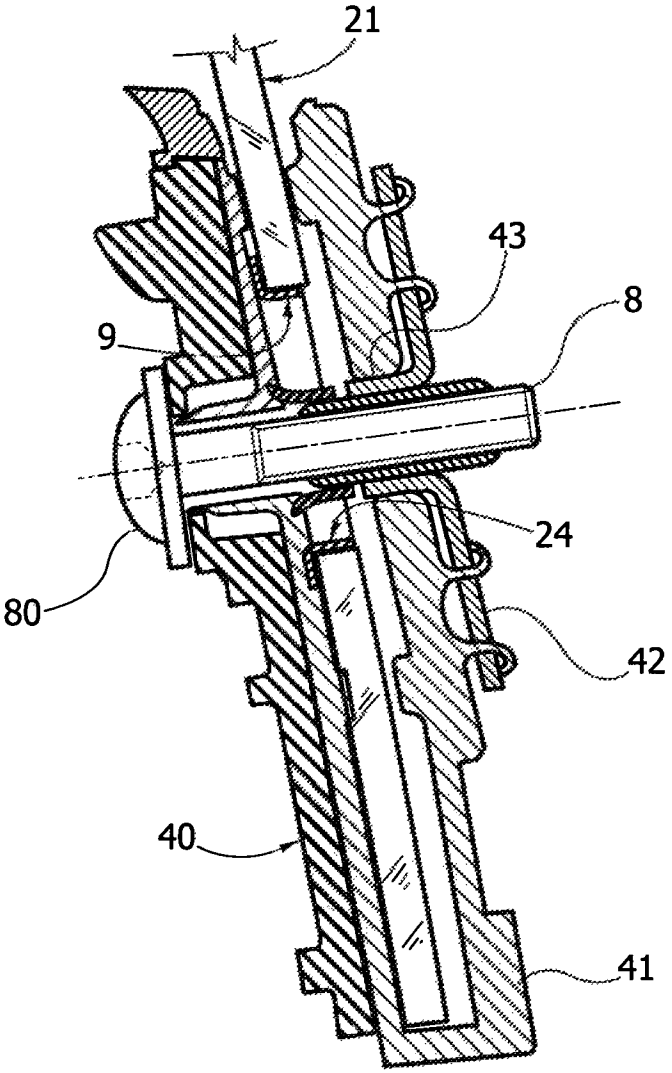
FIG. 6 is a cross-sectional view at an enlarged scale according to the line VI-VI of FIG. 4.
Figure 7A:
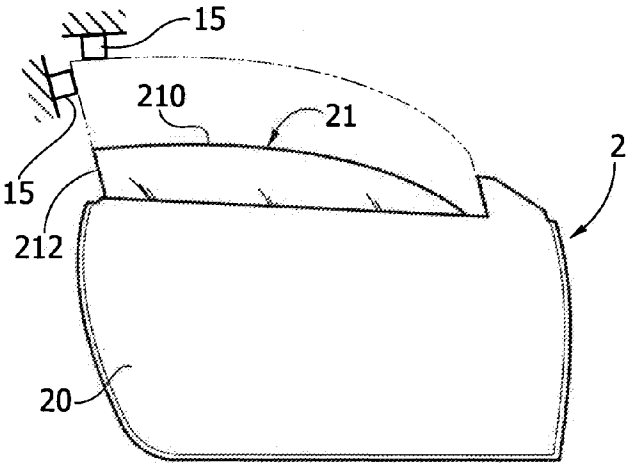
Figure 7B:
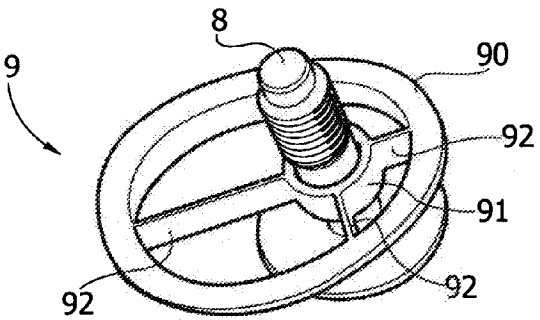

With reference in particular to FIGS. 3, 3A, 4, 4A and above all to FIG. 6, each of the two slider members 4 is secured to the pane 21 by means of a screw 8 that is engaged within a hole 24 made in the pane 21 (FIGS. 3, 3A) with the interposition of an elastically deformable member, designated as a whole by 9 and visible in perspective view and in its undeformed condition in FIG. 7B. As may be seen in said figure, the member 9, which is made of elastomeric material with fibre fillers, comprises a circumferential portion 90, which is mounted with interference fit within the hole 24 (see in particular FIG. 3A) and an internal hub 91, set in a position substantially eccentric with respect to the circumferential portion 90 and joined thereto by four radial tabs 92, diametrally opposite to one another in twos and having different lengths with respect to one another (as a result of the eccentric positioning of the hub 91). In the case of the example illustrated, also the circumferential portion 90 has an oval shape, with a major axis and a minor axis and the eccentric hub 91 set closer to the end of smaller width of the oval shape.

With reference to the specific embodiment illustrated in FIG. 6, the slider member 4, made of plastic material, is fixed on a further bracket made of metal or plastic material, designated as a whole by the reference number 41, which has a U-shaped configuration and is set astride of the bottom edge 25 (FIG. 3) of the pane 21. The element 41 carries a washer 42 with a hub 43, carrying inside it an internally threaded metal bushing 44, functioning as nut for the screw 8. The screw 8 has a head 80 resting on the slider member 4 and is set with play through openings made in the member 4 and in the element 41, as well as engaging within the internally threaded bushing 44.

With reference once again to FIGS. 3 and 3A, the holes 24 provided in the pane 21 have, in the case of the example illustrated, a non-circular profile, of ovoidal shape corresponding to that of the circumferential portion 90 of the deformable element 9, in its undeformed resting condition.

More in particular, the holes 24 have an oval configuration with major axis oriented according to a line b (FIGS. 3, 3A), parallel to the line a constituting the bisectrix of the angle between the top edge 210 and the rear edge 211 of the pane 21. The oval defined by the hole 24 has moreover its narrower end oriented downwards. Consequently, also the element 9 is oriented in a similar way with its major axis c (FIG. 3A).

According to the invention, during assembly of the door described above the aforesaid structure 20 is pre-arranged with the guide elements 3 connected thereto, with the regulating device 5, 7 provided thereon and connected to the slider members 4, and with the pane 21 connected to the slider members 4 by means of the intermediate elements 9 and with the respective screws 8 in a loosened condition so that the elastically deformable members 9 are set in the undeformed condition illustrated in FIG. 7B. The configuration of each element 9 is chosen in such a way that in the aforesaid undeformed condition, the elements 9 keep the pane 21 in an out-of-tolerance position, more raised and set further back, with respect to its correct position of assembly on the slider members 4. In other words, when the deformable elements 9 are set in their resting condition, they keep the pane always and in any case in a wrong position that is vertically more raise and longitudinally set back with respect to the correct position, even taking into account all the possible tolerances.

The pane 21 is initially mounted with the slider members in a partially or completely lowered position. Starting from said condition (which is illustrated in FIG. 7A), the regulating device 5 is activated for bringing the pane 21 up to its position of maximum raising. This is obtained preferably within a workstation located off the motor-vehicle assembly line, where the door, removed from the motor vehicle, undergoes the operation of regulation of the pane. In said workstation a mock-up of the door opening of the body of the motor vehicle is provided, for example constituted even just by two contrast elements 15 designed to engage with the top edge 210 and the rear edge 212 of the pane 21.

Figure 8A:
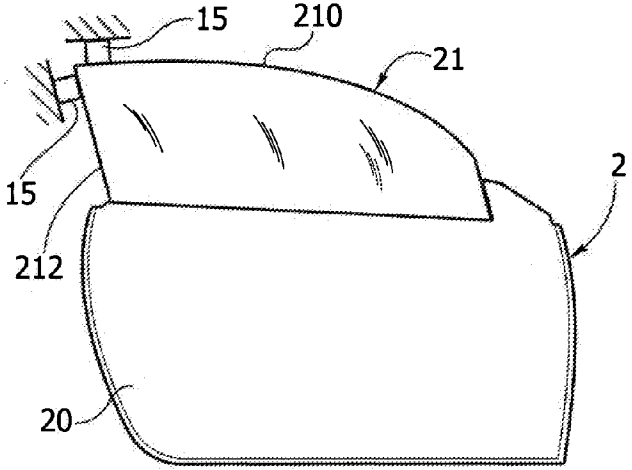
FIGS. 7A, 8A are schematic illustrations of two different steps of the method according to the invention.

Since the deformable elements 9 keep the pane 21 in the aforesaid wrong position, it is certain that, following upon activation of the regulating device 5, the edges 210, 212 of the pane 21 will come into contact with the contrast elements 15 (FIG. 8A) once again before the regulating device 5 is deactivated so that, after said engagement, the further movement upwards of the slider members 4 will cause a lowering and a relative advance of the pane 21 with respect to the slider members 4 (with simultaneous deformation of the members 9 in the configuration illustrated in FIG. 8B), until, when the regulating device 5 has completed its operating step, the pane 21 will have reached its correct position with respect to the slider members 4. In said condition, the screws 8 associated to said slider members are tightened to block the pane 21 in the aforesaid correct position with respect to the slider members 4. In said condition, the members 9 remain in the deformed configuration of FIG. 8, where the peripheral portion 90 has moved into a position more centred with respect to the hub 91, partly moving away from the wider end of the hole 24, with deformation of at least one of the tabs 92.

In theory, it is not excluded that the operation of regulation is carried out directly on the motor-vehicle assembly line, with the door 2 installed. In this case, instead of the contrast elements 15, it is the edges 100, 102 themselves (FIG. 1) of the door opening that co-operate with the pane when the latter is raised to cause the relative movement between pane and the slider members 4 allowed by the elastic deformation of the elements 9.

Of course, in the case where the operation is carried out off-line, in a workstation provided with the contrast elements 15, the latter can be obtained in other known ways. In particular, the contrast elements 15 can be elements that are in turn adjustable in position with respect to a supporting structure provided in the aforesaid workstation, the displacement of the contrast elements with respect to the corresponding support being, for example, controlled by respective actuators of any known type.

Figure 8B:
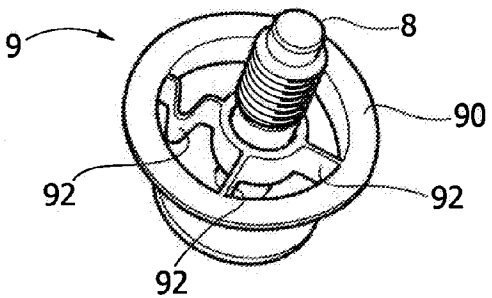
FIGS. 7B and 8B are perspective views of one of the elastically deformable elements set between the pane and the slider members mounted thereon, respectively in the steps illustrated in FIGS. 7A and 8A.

Furthermore, it is evident that the specific configuration of the elastically deformable member 9 that is illustrated in FIGS. 7B, 8B is here given merely by way of example. Each element 9 could have a configuration different from the one illustrated. What is essential is that the element 9 should comprise a body made of elastically deformable material, for example rubber, having a first portion connected to the pane and a second portion that can be secured to the slider member. The configuration of the elastically deformable element must be such that the element, in its undeformed resting condition keeps the pane in the aforesaid wrong position, more raised and/or shifted further longitudinally with respect to the correct position, also taking into account the production tolerances. At the same time, the configuration of the elastically deformable element 9 must be chosen in such a way that said element will enable, with its deformation, a relative movement of the pane with respect to the respective slider member 4 until the correct relative position is reached, which is then ensured with clamping means of any type, such as, for example, the screw 8 that has been described above.

In the case of the example illustrated the guide elements 3 are inclined upwards and backwards, so that when the pane is raised, it also moves back. For this reason, the deformable elements 9 are provided for pushing the pane towards an out-of-tolerance position, which is not only more raised, but also shifted further back with respect to the correct position. If, let's say, the guide elements 3, viewed laterally, were exactly vertical, the elements 9 would be arranged for pushing the pane vertically towards a position above the correct position.

In theory, the door and the method according to the invention could be limited to applying the principles of the invention that have been described above with reference to the regulation of the correct position of the pane in the vertical direction and in the longitudinal direction. In this case, the regulation of the portion of the pane in the direction orthogonal to the general plane of the pane can be obtained in a way corresponding to the known art, and the guide elements 3 can be secured to the structure of the door in a way in itself known.

Preferably, however, in order to simplify also the operation of regulation of the position of the pane in the direction orthogonal to the general plane of the pane, each of the guide elements 3 has a top end connected in articulated way about a longitudinal axis 30 (see FIGS. 5, 5A) to a bracket 31 forming part of the structure of the door. As illustrated in detail in FIG.

Figure 9:
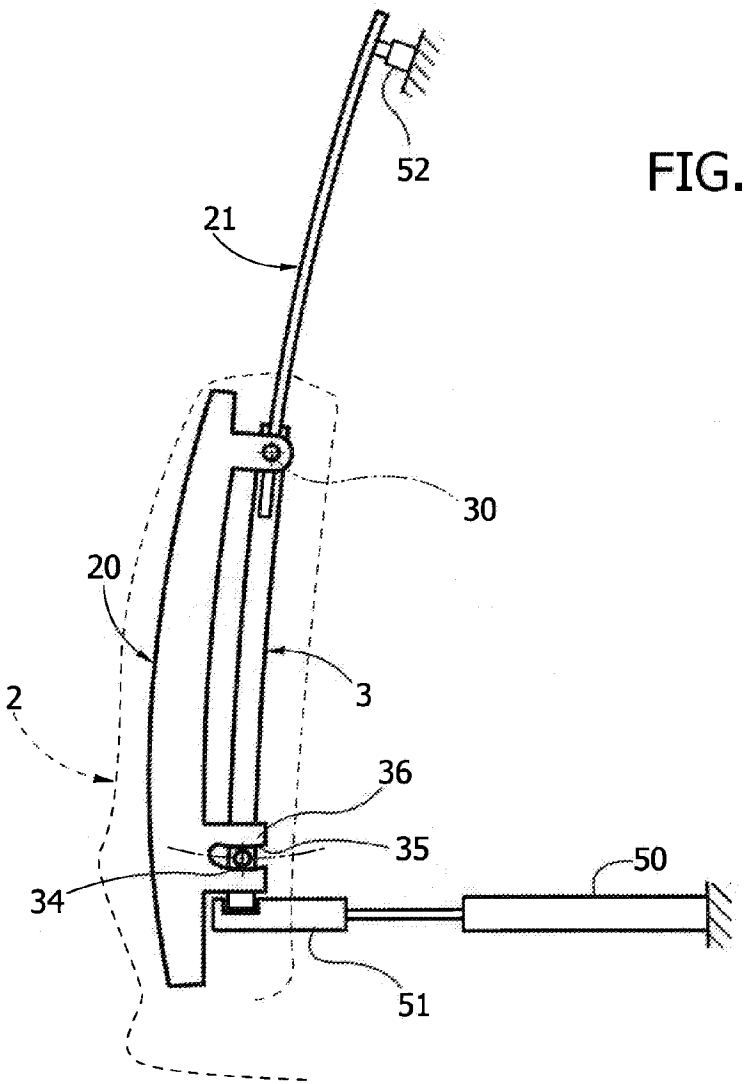
FIG. 9 is an end-on view of the door according to the invention, which shows schematically the means that enable regulation of the position of the pane in the direction orthogonal to the general plane of the pane.

5A, in the case of the example illustrated, said articulated connection is obtained by means of a screw 32 secured to the top end of the guide element 3 and blocked within a slit 33 of the bracket 31. Of course, the two pins-screws 32 associated to the two guide elements 3 are aligned according to the same longitudinal axis 30 in such a way that, as illustrated schematically in FIG. 9, the ensemble constituted by the two guide elements 3 and by the pane 21 is supported in an oscillating way, like a rocker, about the axis 30. As may be seen in detail in FIGS. 5 and 5B and as is illustrated also schematically in FIG. 9, the bottom end of the guide element 3 carries a pin-screw 34, extending in a longitudinal direction, which is engaged in a slit 35 of a bracket 36 secured to the structure of the body. As illustrated schematically in FIG. 9, the slit 35 is arc-shaped, according to an arc concentric with the axis 30. The curvature of the slit 35 is not visible in FIGS. 5, 5B simply in so far as it corresponds to a relatively large radius of curvature.

In order to adjust the position of the pane in the direction orthogonal to the general plane of the pane at the top edge of the pane, a workstation is preferably provided for regulation off the motor-vehicle assembly line (which can be the same workstation as the one where the regulation of the position of the pane in the vertical direction and in the longitudinal direction is carried out) provided with suitable actuator means 50 (represented in FIG. 9 in the form of an actuator cylinder) with a gripping member 51, which enables displacement of the lower ends of the guide elements 3 in a plane orthogonal to the axis 30, causing rotation of the elements 3 about the axis 30. Accordingly, by keeping the pane 21 in its raised position, an engagement of the top edge of the pane is obtained against a contrast element 52 of a type similar to the contrast elements 15 of FIGS. 7A, 8A, which is also preferably of a type adjustable in position by means of corresponding actuator means (not illustrated) and can be provided with sensor means designed to detect the force applied by the edge of the pane 21 against the contrast element 52. The contrast element 52 simulates the weatherproofing element provided along the top edge of the door opening 10 (FIG. 1) of the motor vehicle, against which the pane 21 must be pressed correctly when it is set in its closed position in order to guarantee proper weatherproofing against water and air. Once the pane is brought into a position detected as correct, via its rotation about the axis 30, the position of the guide elements 3 is blocked by gripping of the screws 34 associated to their bottom ends.

Of course, without prejudice to the principle of the invention, the details of construction and the embodiments may vary widely with respect to what has been described and illustrated herein purely by way of example, without thereby departing from the scope of the present invention, as defined in the annexed claims.

For example, with reference to the specific configuration of the elastically deformable element 9, which is illustrated in FIG. 7B, it is possible to envisage that said element has the tabs 92 that are always diametrally opposite to one another in twos but not arranged along the major axis, but rather according to an X configuration, symmetrical with respect to the major axis of the oval profile. As has been said, it would be in any case possible to adopt configurations even altogether different, but having at the same time a first portion designed to be connected to the pane, a second portion designed to be secured to the respective slider member, and one or more connection elements between said portions, which enable the operative characteristics that have been defined above to be achieved.

The regulation method described above can be carried out in a dedicated assembly workstation alongside the vehicle assembly line. Said workstation will be provided with a tool that will enable referencing of the door module on its interfaces with the body and with the necessary contrast elements 15 and 52 fitted on mobile slides located thereon on the basis of the measurements carried out on the body of the motor vehicle, in an automatic way, using actuator means that receive signals at output from the opto-electronic detection systems, which are able to determine the geometrical compensations necessary for proper coupling of the door, complete with window raised, with its own seat on the body.

What is claimed is:

1. A motor-vehicle door with a frameless window, comprising:

a door structure;

a window pane, slidably mounted on the door structure between a lowered position and a raised position in which a top edge, a front edge and a rear edge of said window pane come directly into contact with corresponding portions of an opening for the door defined by a body of a motor vehicle; and a window pane lifting and lowering device for controlling movement of the window pane between a lowered position and a raised position, wherein at least one slider member is connected to said window pane, said slider member slidably engaging a respective guide element mounted on the door structure, for guiding the movement of the window pane between its lowered position and its raised position, wherein said slider member is connected to said window-pane by an elastically deformable member which allows the position of the window pane relative to the slider member to be adjusted by the elastic deformation of said elastically deformable member, wherein means for clamping are associated with said slider member and are operable for clamping the slider member onto the window pane in a given position of said window pane relative to said slider member, wherein when said means for clamping are released said elastically deformable member is in a rest undeformed configuration, and wherein when the elastically deformable member is in said rest undeformed configuration, the window pane is in a position relative to the slider member such that when the window pane is in its raised position it is in an out-of-tolerance position, shifted upwardly and rearwardly, so that following full lifting of the window pane, with the door closed, said edges of the window pane come into direct contact with the vehicle structure, before lifting of the slider member is completed, so that in the final part of the window pane lifting movement, the window pane is moved relative to said slider member with a resulting deformation of said elastically deformable member, said means for clamping being adapted to be operated after the deformation of the elastically deformable member is reached, so as to clamp the window pane in the corresponding position relative to the slider member, wherein said elastically deformable member comprises a first section, connected to the window pane, a second section, which can be secured to said slider member, and one or more portions of connection between said first section and said second section, wherein said first section is a circumferential section, said second section is a hub section, set inside said circumferential section, and said connection portions are in the form of tabs which extend between the circumferential section and the hub section, wherein said circumferential section has an oval configuration and in that in its undeformed condition the aforesaid hub section has an eccentric position, set closer to the narrower end of the oval configuration, wherein said circumferential section is received in a corresponding hole of the pane, said hole having a profile corresponding to the profile of the aforesaid circumferential section in the undeformed condition.

2. The door according to claim 1, wherein said window pane is connected to two slider members, which engage two respective guide elements, each slider member being connected to the window pane with the interposition of a respective elastically deformable member, which in its resting configuration keeps the window pane in the aforesaid out-of-tolerance position.

3. The motor-vehicle according to claim 1, wherein said hole comprises an oval profile made in the pane and has a major axis of the oval profile oriented obliquely both with respect to a vertical direction of the pane and with respect to a horizontal direction of the pane.

4. The motor-vehicle according to claim 3, wherein said pane has a top edge and a rear edge that form between them an angle and in that the major axis of the oval profile of the hole is oriented substantially according to a direction parallel to the direction of the straight line that is the bisectrix of the aforesaid angle.

5. The motor-vehicle according to claim 1, wherein said guide element has a top end connected in an articulated way to the door structure about a longitudinal axis and in that means are provided for blocking said guide element in a pre-set position about said axis on said door structure.

6. The motor-vehicle door according to claim 2, wherein said elastically deformable member comprises a first section, connected to the window pane, a second section, which can be secured to said slider member, and one or more portions of connection between said first section and second section.

7. The motor-vehicle according to claim 2, wherein said guide element has a top end connected in an articulated way to the door structure about a longitudinal axis and in that means are provided for blocking said guide element in a pre-set position about, said axis on said door structure.

8. The motor-vehicle according claim 3, wherein said guide element has a top end connected in an articulated way to the door structure about a longitudinal axis and in that means are provided for blocking said guide element in a pre-set position about said axis on said door structure.

9. A motor-vehicle side door with a frameless window, comprising:

a door structure:

a window pane, slidably mounted on the door structure between a lowered position and a raised position in which a top edge, a front edge and a rear edge of said window pane come directly into contact with corresponding portions of an opening for the door defined by a body of a motor vehicle; and a window pane lifting and lowering device for controlling movement of the window pane between a lowered position and a raised position, at least one slider member connected to said window pane, said slider member slidably engaging a respective guide element mounted on the door structure, for guiding the movement of the window pane between the lowered position and the raised position, said slider member connected to said window pane by an elastically deformable connecting member which allows the position of the window pane relative to the slider member to be adjusted by the elastic deformation of said elastically deformable member, means for clamping associated with said slider member and operable for clamping the slider member onto the window pane in a given position of said window pane relative to said slider member, wherein when the elastically deformable member is in a rest undeformed configuration, the window pane is in a position relative to the slider member such that said edges of the window pane come into direct contact with said corresponding portions of the door opening in the body of the vehicle before lifting of the slider member is completed, said elastically deformable member reaches a deformed configuration in response to the window pane moving relative to said slider member, said means for clamping being clamped when said elastically deformable member is in said deformed configuration to connect said window pane to said slider member to result in an adjustment of said window pane relative to said slider member, wherein said elastically deformable member comprises a first section, connected to the window pane, a second section, which can be secured to said slider member, and one or more portions of connection between said first section and said second section, wherein said first section is a circumferential section, said second section is a hub section, set inside said circumferential section, and said connection portions are in the form of tabs which extend between the circumferential section and the hub section, wherein said circumferential section has an oval configuration and in that in its undeformed condition the aforesaid hub section has an eccentric position, set closer to the narrower end of the oval configuration, wherein said circumferential section is received in a corresponding hole of the pane, said hole having a profile corresponding to the profile of the aforesaid circumferential section in the undeformed condition.

10. A method for assembly of a door according to claim 1 wherein;

the door is pre-arranged with at least one guide element of the pane, with said slider member engaged within said guide element, with said regulating device mounted on said door structure and operatively connected to said slider member, with said pane connected to said slider member with the interposition of said elastically deformable member, and with said means for clamping initially in a released condition so that the elastically deformable member is in its undeformed condition and the pane is consequently kept thereby in the out-of-tolerance position, at least one of more raised or shifted further longitudinally, with respect to its correct position of assembly on said slider member, said pane being provided in a position set away from its completely raised position;

starting from said condition the regulating device is activated to bring about a movement of the window pane up to its raised closing position, in which it comes into contact against the edge of the motor-vehicle door opening or against a mock-up of the edge of the door opening;

so that in said raised closing position the window pane moves automatically into the correct position with respect to the slider member, with simultaneous deformation of said elastically deformable member; and wherein in said condition the connection between the pane and the slider member is blocked by means for clamping.

11. The method according to claim 10, wherein the guide element is provided with a top end connected to the door structure in an articulated way about a longitudinal axis and wherein means are provided for blocking, the guide element on said door structure in a given position about said axis of articulation, and wherein said pane is arranged in its position of maximum raising and the guide element is made to oscillate about said axis of articulation, until proper engagement of the top edge of the pane is obtained in the direction orthogonal to the general plane of the pane, against the edge of the motor-vehicle door opening or against a mock-up of the edge of the door opening, after which the guide element is blocked in the position reached about said axis of articulation.

12. The method according to claim 10, wherein said operation of regulation of the correct position of the pane is carried out in a dedicated workstation, off the motor-vehicle assembly line, by providing contrast elements that simulate the edge of the motor-vehicle door opening that is to come in contact with the edge of the pane in the closed condition of the latter, in that said contrast elements are controlled in position by respective means for actuating, and in that said means for actuating are governed as a function of signals issued by measuring means designed to detect the edge of the motor-vehicle door opening.

* * * * *